US007966832B1

(12) United States Patent
Lockyer et al.

(10) Patent No.: US 7,966,832 B1
(45) Date of Patent: Jun. 28, 2011

(54) COMBUSTOR

(75) Inventors: John Frederick Lockyer, San Diego, CA (US); Stuart Alexander Greenwood, San Diego, CA (US)

(73) Assignee: Solar Turbines Inc, San Diego, CA (US)

( * ) Notice: Subject to any disclaimer, the term of this patent is extended or adjusted under 35 U.S.C. 154(b) by 813 days.

(21) Appl. No.: 11/024,070

(22) Filed: Dec. 29, 2004

(51) Int. Cl.
*F02C 7/20* (2006.01)
*F23R 3/50* (2006.01)

(52) U.S. Cl. ..... 60/800; 60/804; 60/755

(58) Field of Classification Search ..... 60/737, 60/746, 747, 748, 755, 756, 800, 804
See application file for complete search history.

(56) References Cited

U.S. PATENT DOCUMENTS

| | | | | |
|---|---|---|---|---|
| 3,443,792 | A * | 5/1969 | Moss | 416/92 |
| 3,831,854 | A * | 8/1974 | Sato et al. | 60/748 |
| 4,454,711 | A * | 6/1984 | Ben-Porat | 60/800 |
| 4,458,479 | A * | 7/1984 | Reider et al. | 60/800 |
| 5,285,632 | A | 2/1994 | Halila | |
| 5,291,732 | A | 3/1994 | Halila | |
| 5,291,733 | A | 3/1994 | Halila | |
| 5,664,412 | A * | 9/1997 | Overton | 60/748 |
| 6,341,485 | B1 * | 1/2002 | Liebe | 60/800 |
| 6,705,087 | B1 * | 3/2004 | Ohri et al. | 60/748 |
| 6,959,551 | B2 * | 11/2005 | Baudoin et al. | 60/748 |
| 7,089,748 | B2 * | 8/2006 | Tiemann | 60/800 |
| 2004/0118122 | A1 | 6/2004 | Mitchell et al. | |

* cited by examiner

*Primary Examiner* — Ted Kim
(74) *Attorney, Agent, or Firm* — Finnegan, Henderson, Farabow, Garrett & Dunner LLP; Andrew J. Ririe

(57) ABSTRACT

A combustor includes a first wall, a second wall, an injector grommet, a combustor longitudinal axis, and a connection assembly indirectly connecting the first wall to the second wall. A portion of the injector grommet is disposed within a groove of the connection assembly.

17 Claims, 7 Drawing Sheets

COMBUSTOR

TECHNICAL FIELD

This disclosure relates generally to a system and method for connecting components of a gas turbine engine combustor and, more particularly, to a system and method for connecting components of a gas turbine engine combustor so as to accommodate thermal growth of the components.

BACKGROUND

Gas turbine engines are often used as a power source in machines. Typical gas turbine engines may use a compressor to provide compressed air to a combustor, and fuel may be injected into the combustor by a fuel injector. The compressed air may be mixed with fuel in the combustor and may be ignited by conventional means to generate combustion gasses. The combustion gasses may be discharged from the combustor into a conventional turbine, which may extract energy from the gasses to power various components of the engine and/or machine.

During operation, temperatures within the combustor may increase due to the exothermic combustion of the fuel/air mixture. The highest temperatures may be experienced by components located proximate the fuel injector. The components of the combustor closest to the fuel injector may, thus, experience the greatest increase in temperature, while those shielded and/or further removed from the injector may experience a smaller increase. Due to this larger increase in temperature, the components closest to the injector may also experience greater thermal expansion than the shielded components. As a result of the different levels of thermal expansion experienced by the combustor components, directly connecting these components to each other may cause damage to the components over time and may reduce the active life of the combustor. In conventional gas turbine engines, combustor components may be connected together indirectly so as to allow for relative movement of the components. Such engines may also cool the combustor components through conventional impingement cooling methods wherein jets of cooling air are directed onto hot components of the combustor.

For example, U.S. Pat. No. 5,291,732 to Halila ("the '732 patent") describes a combustor having a casing, a frame, and a liner. The frame is rigidly connected to combustor casing and is configured to support the liner within the casing. The liner is joined to the frame by pins extending through holes in the liner. Other combustor components are also joined to the frame by the pins, and the pins allow differential thermal expansion and contraction between the components connected thereto. The pins are disposed away from the combustion zone, in a relatively cool region of the combustor. In this region, the components may experience a relatively small difference in thermal expansion, whereas the same components may experience a much larger amount of expansion closer to the combustion zone.

Although the assembly described in the '732 patent may allow for relative movement between the different components of the combustor due to varying amounts of thermal expansion, connecting the components upstream of the combustion zone may result in high thermal stresses on the pinned components during operation of the combustor. These high thermal stresses may occur as a result of the difference in temperature between the combustion zone and the relatively cool region of the combustor where the components are pinned. Such stresses may cause failure in combustor components made of materials having a high coefficient of expansion. To avoid such stress-induced failures, materials having lower coefficients of expansion may be used as an alternative. Such materials, however, may be expensive and may increase the overall cost of the combustor.

SUMMARY OF THE INVENTION

In an embodiment of the present disclosure, a combustor includes a first wall, a second wall, an injector grommet, a combustor longitudinal axis, and a connection assembly. The connection assembly indirectly connects the first wall to the second wall. A portion of the injector grommet is disposed within a groove of the connection assembly.

In another embodiment of the present disclosure, a combustor includes a first wall, a second wall, an injector grommet, a combustor longitudinal axis, and a connection assembly. The connection assembly indirectly connects the first wall to the second wall. A portion of the injector grommet is indirectly connected to the connection assembly.

In yet another embodiment of the present disclosure, an annular combustor of a gas turbine engine includes a first wall, a second wall, a combustor longitudinal axis, and a connection assembly indirectly connecting the first wall to the second wall. The connection assembly and a portion of the second wall provide for a non-uniform gap therebetween.

In still another embodiment of the present disclosure, a method of connecting a first wall to a second wall in an annular combustor of a gas turbine engine includes directly connecting the first wall to a connection assembly and indirectly connecting the first wall to the second wall at a forward end of the annular combustor. The method further includes indirectly connecting an injector grommet of the annular combustor to the connection assembly.

DETAILED DESCRIPTION

Figure 1:
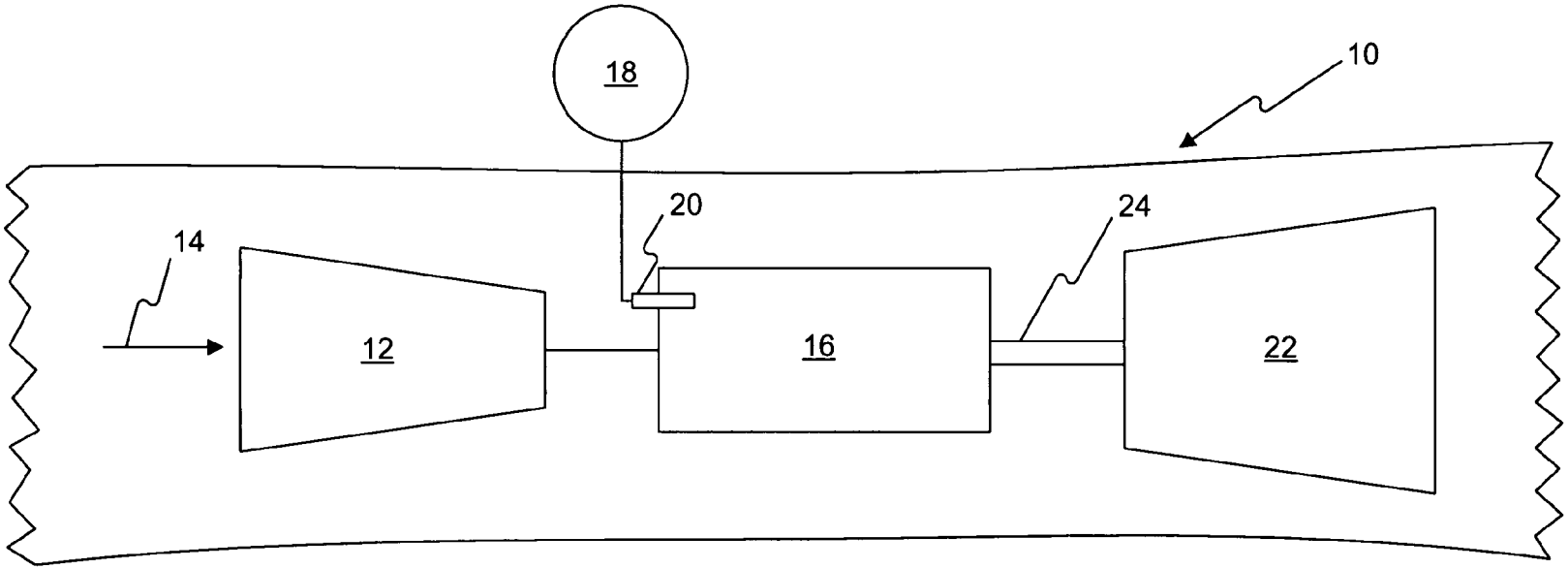
FIG. 1 is a schematic view of a gas turbine engine according to an exemplary embodiment of the present disclosure.

FIG. 1 is a schematic illustration of an exemplary gas turbine engine 10. The engine 10 may be used to provide power in a variety of applications. In an exemplary embodiment, the engine 10 may include, inter alia, a compressor 12, a combustor 16, and a turbine 22. The compressor 12 may receive a flow of air, as illustrated by arrow 14, which may be compressed therein and may be channeled to a combustor 16. The combustor type utilized with the present disclosure may be, for example, annular, can-annular, or silo, or any other type of combustor known in the art configured to combine compressed air from a compressor with fuel. The air/fuel mixture may be ignited in the combustor 16 to produce combustion gasses. The combustor 16 may be supplied with fuel by a fuel source 18, such as, for example, a fuel tank. The fuel source 18 may channel the fuel to one or more fuel injectors 20 by any conventional means. The fuel injectors 20 may be positioned to inject fuel in a desirable manner and may thereby assist in the combustion process. In an exemplary embodiment, a plurality of fuel injectors 20 may be circumferentially spaced about the combustor 16.

The hot combustion gasses produced in the combustor 16 may be discharged into a turbine 22 connected downstream of the combustor 16 by conventional means. The turbine 22 may include a shaft 24 having a plurality of fins. In an exemplary embodiment (not shown), the shaft 24 may extend to the compressor 12 to drive the compressor 12. It is understood that the expansion of gasses within the turbine 22 may exert a force on the fins, thereby rotating the shaft 24. As such, the turbine 22 may be configured to extract energy from the combustion gasses. The energy extracted by the turbine 22 may be used to power, for example, components of the engine 10, such as the compressor 12.

Figure 2:
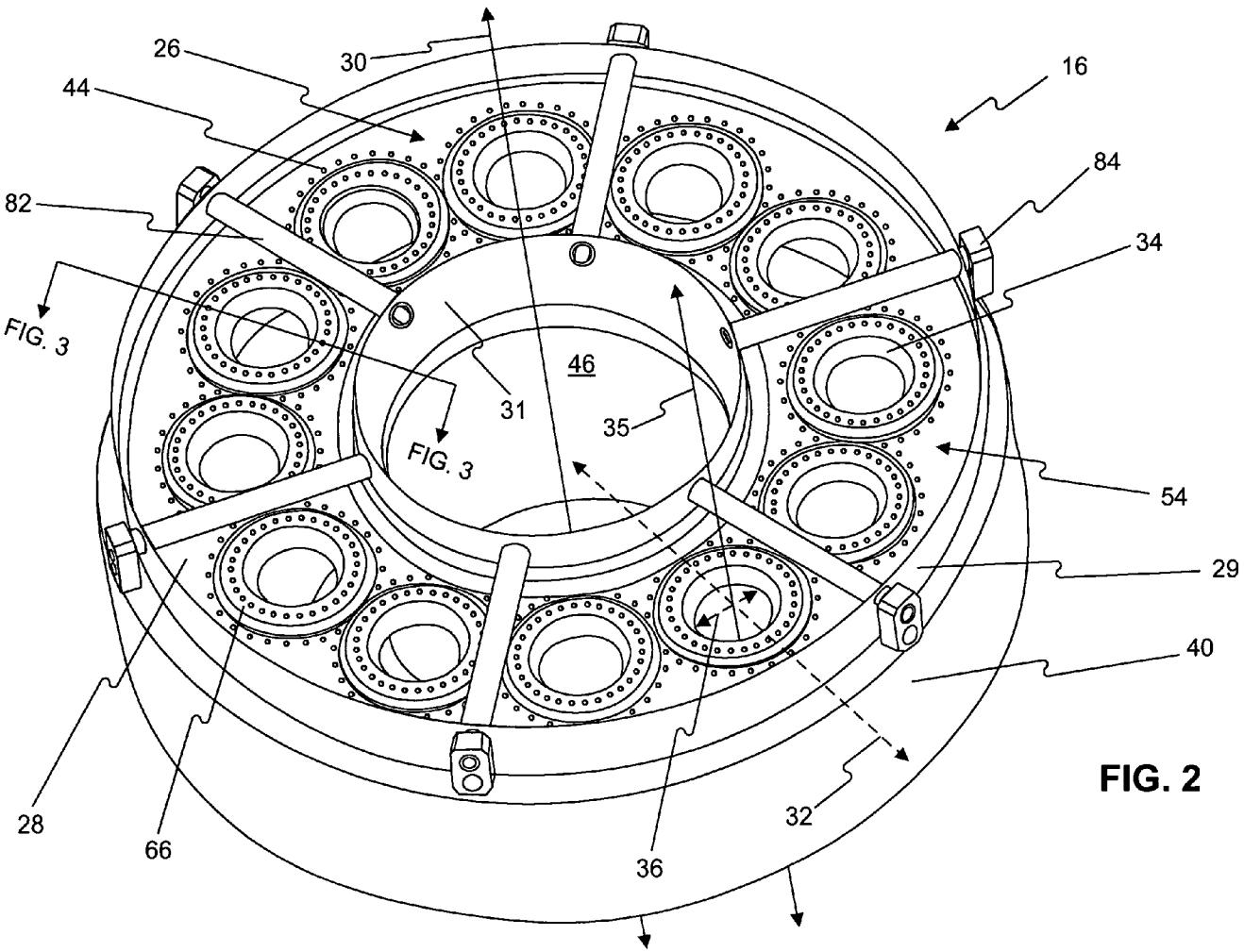
FIG. 2 is an isometric view of a combustor according to an exemplary embodiment of the present disclosure.

The combustor 16 is illustrated in greater detail in FIG. 2. The combustor 16 may be any size and/or shape known in the art and, in an exemplary embodiment, the combustor 16 may be substantially cylindrical. The combustor 16 may include a cold dome 26 disposed about a forward end 54 of the combustor 16. The cold dome 26 may be a wall of the combustor 16 and may include a cold dome face 28 connecting an outer ring 29 of the cold dome 26 to an inner ring 31 of the cold dome 26. As shown in FIG. 2, the cold dome face 28 may be disposed substantially perpendicular to the longitudinal combustor axis 30. The combustor 16 may also include a number of injector grommets 34 disposed radially about the longitudinal combustor axis 30. Each injector grommet 34 may include a longitudinal injector grommet axis 35 that is substantially parallel to the longitudinal combustor axis 30.

As will be described in greater detail below, components of the combustor 16 may be configured to expand in a direction 32 radial to the longitudinal combustor axis 30 due to thermal expansion as their temperatures increase. Hereinafter, this direction will be referred to as "an aligned radial direction" 32. Components of the combustor 16 may be restricted, however, from moving in a direction 36 radial to the longitudinal injector grommet axis 35 and normal to the aligned radial direction 32 in a plane substantially normal to the longitudinal combustor axis 30. In addition, it is understood that in an embodiment of the present disclosure, a portion of the cold dome 26 may be canted. For example, in such an embodiment the cold dome face 28 and the injector grommets 34 may include a canted longitudinal injector grommet axis (not shown) at an acute angle to the longitudinal combustor axis 30. The canted longitudinal injector grommet axis may be at any conventional angle to the longitudinal combustor axis 30. In an embodiment, the acute angle may be approximately 8°.

Figure 3:
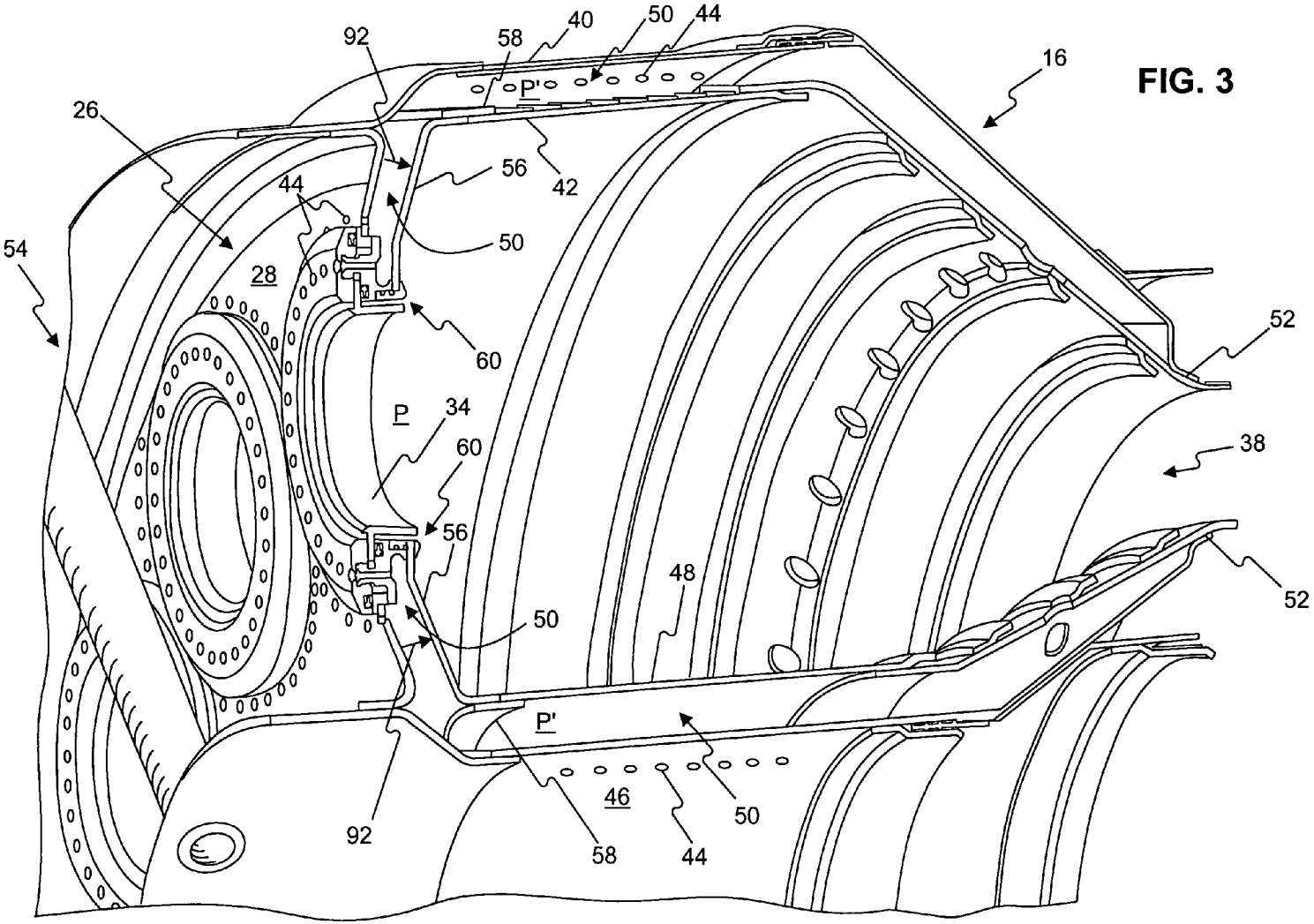
FIG. 3 is a partial cross-sectional view of the combustor of FIG. 2 taken at section 3-3 of FIG. 2.

FIG. 3 is a cross-sectional view of a portion of the combustor 16 of FIG. 2. As shown, the combustor 16 further includes an outer cold liner 40 and an outer hot liner 42. The outer liners 40, 42 are disposed substantially parallel to each other, and each extend substantially parallel to the longitudinal combustor axis 30 (FIG. 2) of the combustor 16. The outer liners 40, 42 may be made from any material known in the art, such as, for example, steel, and/or other metals or high temperature alloys. The outer liners 40, 42 may also be made of any composite known in the art and the liners 40, 42 may be made of the same or different materials. The materials constituting the outer liners 40, 42 may be capable of withstanding temperatures of approximately 1700° F. However, the outer liners 40, 42 may be exposed to combustion temperatures of approximately 3500° F. Accordingly, it may be necessary to cool, for example, the outer hot liner 42 through, for example, conventional impingement cooling methods in order to withstand such combustion temperatures. During impingement cooling, cooling air may be supplied by the compressor 12 (FIG. 1) and may be directed to the outer liners 40, 42 through impingement holes 44 defined by, for example, the cold dome 26. As shown in FIG. 3, the cold dome face 28 may define a plurality of impingement holes 44 positioned, sized, and/or otherwise configured to direct the cooling air. It is understood that the outer cold liner 40 and the inner cold liner 46 may also include a plurality of impingement holes 44 to positioned, sized, and/or otherwise configured to direct the cooling air.

The combustor 16 may also include an inner cold liner 46 and an inner hot liner 48. The inner liners 46, 48 may be mechanically similar to the outer liners 40, 42 described above. The inner liners 46, 48 may also be disposed substantially parallel to each other, and each may extend substantially parallel to the longitudinal combustor axis 30 (FIG. 2). It is understood that a fuel injector (FIG. 1) may be mounted to each of the injector grommets 34 and at least a portion of the fuel injector may be disposed within the combustor 16. In an exemplary embodiment, the outer hot liner 42 and the inner hot liner 48 may partially define the boundary of the combustion reaction within the combustor 16 and may be disposed closer to the fuel injector than the outer cold liner 40 and the inner cold liner 46. Thus, during operation, the outer hot liner 42 and the inner hot liner 48 may be exposed to higher temperatures than the outer cold liner 40 and the inner cold liner 46. Accordingly, during operation, the outer hot liner 42 and the inner hot liner 48 may experience greater thermal expansion than the outer cold liner 40 and the inner cold liner 46.

As shown in FIG. 3, the outer liners 40, 42 and the inner liners 46, 48 may at least partially define a channel 50 therebetween for the passage of cooling air from the impingement holes 44. The channel 50 may be configured to assist in cooling at least one of the outer liners 40, 42 and the inner liners 46, 48. The outer cold liner 40 may be connected to the outer hot liner 42 at an aft end 38 of the combustor 16, and the inner cold liner 46 and the inner hot liner 48 may also be connected at the aft end 38. The aft connections 52 may be direct connections. As used herein, the term "direct connection" may be defined as a rigid and/or fixed connection between two objects such that there is no relative movement between the connected pieces. Such a connection may be made through, for example, brazing, welding, bolting, corresponding threads, and/or other conventional means. In an exemplary embodiment, the outer cold liner 40 and the inner cold liner 46 may be directly connected to the cold dome 26 at the forward end 54 of the combustor 16.

As shown in FIG. 3, the combustor 16 may further include a hot dome 56. The hot dome 56 may be a wall of the combustor 16 and may assist in partially defining the boundary of the combustion reaction within the combustor 16. The hot dome 56 may be directly connected to the outer hot liner 42 and the inner hot liner 48. A doubler 58 may be used to facilitate this direct connection and may be, for example, welded to both the outer hot liner 42 and the hot dome 56, and to the inner hot liner 48 and the hot dome 56. The hot dome 56 may be formed from the same or similar materials used to form the liners 40, 42, 46, 48. The hot dome 56 may be closer to the fuel injector 20 (FIG. 1), and/or the combustion reaction occurring within the combustor 16 during operation, than the cold dome 26. As a result, the hot dome 56 may have a higher temperature and may experience greater thermal expansion than the cold dome 26 during operation of the combustor 16. The hot dome 56 may be indirectly connected to the cold dome 26 by a connection assembly 60. As used herein, the term "indirect connection" may be defined as a sliding and/or grooved connection between two objects such that the objects may be substantially fixed relative to each other while allowing relative movement between the objects in at least one direction. Such a connection may have, for example, tongue and groove, fish mouth, keyed, dovetail, and/or other conventional configurations allowing for relative movement. The hot dome 56 and the cold dome 26 may at least partially define the channel 50, thus, the channel 50 may be configured to assist in cooling at least one of the hot dome 56 and the cold dome 26. It is understood that the combustor components of the present disclosure may be connected and/or otherwise configured to substantially restrict cooling air from entering the combustion zone. In particular, the components discussed herein may be connected so as to substantially prohibit impingement air from entering the combustion reaction, and may, thereby, substantially reduce and/or eliminate unacceptable CO emissions during operation.

Figure 4:
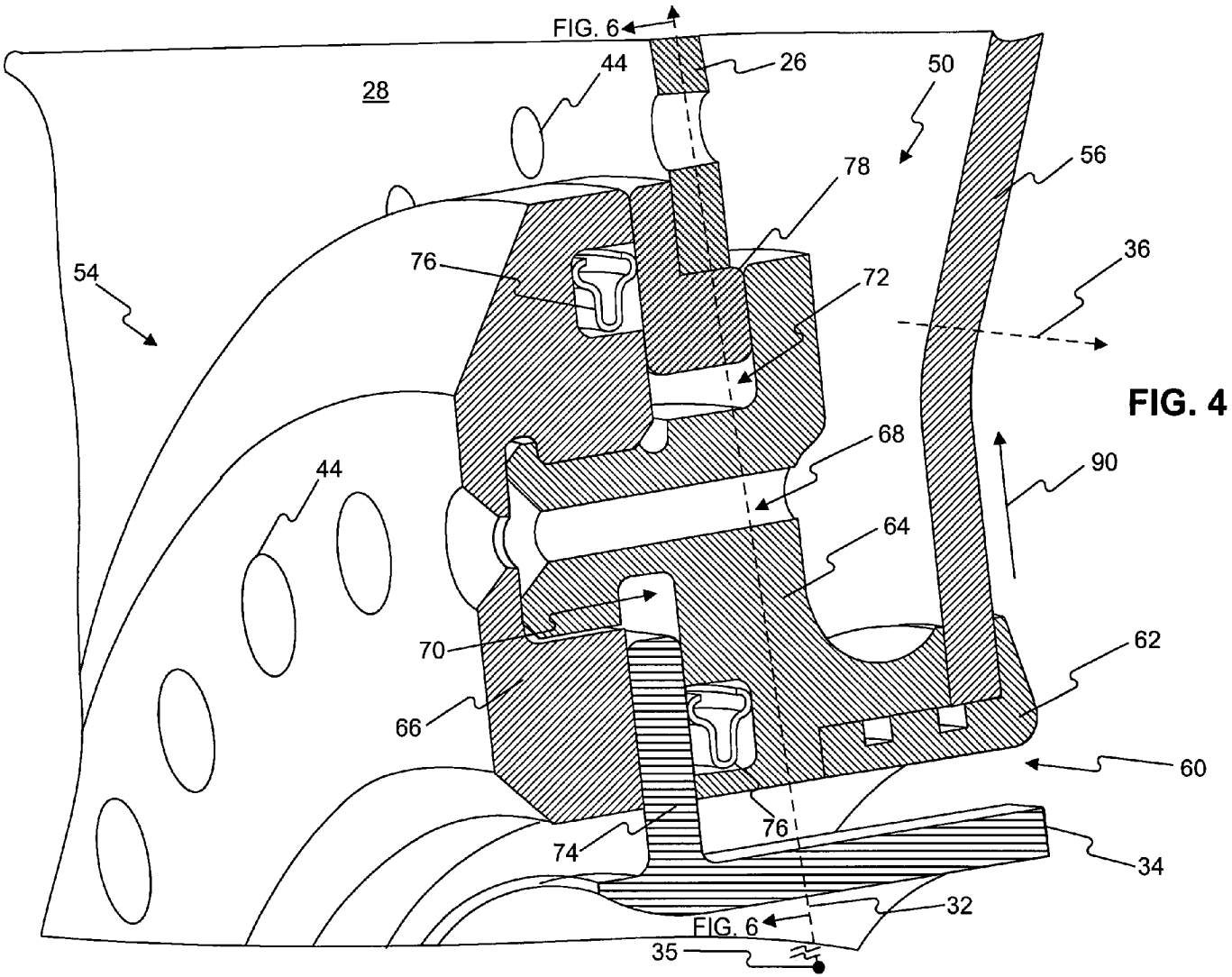
FIG. 4 is another partial cross-sectional view of the combustor of FIG. 2.

As shown in FIG. 4, the connection assembly 60 may include a connector 62, a grommet housing 64, and a grommet retainer 66. The hot dome 56 may be directly connected to the connection assembly 60 by the connector 62 and, thus, the connection assembly 60 may move with the hot dome 56 as the hot dome 56 experiences, for example, thermal expansion and/or contraction. The connector 62 may have a substantially L-shaped cross-section and may be substantially ring-shaped or any other shape to facilitate a direct connection between the hot dome 56 and a component of the connection assembly 60, such as, for example, the grommet housing 64. In an exemplary embodiment, a direct connection may be made between the hot dome 56 and the grommet housing 64 through brazing. The components of the connection assembly 60 may be formed from the same or similar materials as those described above with respect to the outer liners 40, 42.

The grommet retainer 66 may be directly connected to the grommet housing 64. In an exemplary embodiment, the grommet housing 64 and the grommet retainer 66 may include matching or corresponding threads to facilitate this connection. Such a threaded direct connection may be useful in, for example, installing and removing components of the combustor 16. In a further exemplary embodiment, the grommet housing 64 and the grommet retainer 66 may have a one-piece construction. The grommet housing 64 and the grommet retainer 66 may substantially restrain the hot dome 56 from moving in the direction of the longitudinal injector grommet axis 35 (FIG. 2). While FIG. 4 shows a cross-sectional view of an exemplary grommet housing 64 and grommet retainer 66, it is understood that the grommet housing 64 and grommet retainer 66 may be substantially ring-shaped or any other shape or cross-sectional configuration known in the art.

The grommet housing 64 may define a plurality of passages 68 configured to direct impingement air to, for example, a surface of the hot dome 56. The impingement holes 44 of the grommet retainer 66 may be aligned with the passages 68 to facilitate the flow of impingement air, and may be sized, shaped, and/or otherwise configured to assist in the impingement cooling process. The grommet housing 64 may further define an inner groove 70 and an outer groove 72. In an exemplary embodiment, a portion of the inner groove 70 may be defined by both the grommet housing 64 and the grommet retainer 66. The inner groove 70 may be sized to accept a portion of the injector grommet 34. A tongue 74 and/or other portion of the injector grommet 34 may be disposed within the inner groove 70, and may be disposed between the grommet housing 64 and the grommet retainer 66. In such an embodiment, the injector grommet 34 may be indirectly connected to the connection assembly 60.

As shown in FIG. 4, the connection assembly 60 may further include a V-seal 76 or other like mechanism to form a substantially air-tight seal between the tongue 74 and the connection assembly 60 while allowing for relative movement therebetween. The V-seal 76 may be compressed by the tongue 74 and the grommet housing 64, and may apply a force to the tongue 74 and the grommet housing 64 to assist in forming this seal. The inner groove 70 may be appropriately sized and shaped to accept the tongue 74 and to allow for, for example, thermal expansion and/or contraction of the injector grommet 34. In an exemplary embodiment, the inner groove 70 may be configured to permit movement of the injector grommet 34 relative to the grommet housing 64 in the direction of aligned radial direction arrow 32. The groove 70 may also allow for varying tolerances of the injector 20 used in the combustor 16. It is understood that the injector grommet 34 may be rigidly connected to the injector 20 and may remain coaxial therewith during operation of the combustor 16.

The outer groove 72 may be configured to accept a portion of the cold dome 26 and, as will be discussed below, allow for movement in the aligned radial direction 32 and restrict movement in the normal radial direction 36 (FIG. 2). As shown in FIG. 4, a cold dome grommet 78 may be directly connected to the cold dome 26. The cold dome grommet 78 may have one or more machined surfaces and may assist in forming a substantially air-tight seal between the cold dome 26 and the connection assembly 60. As shown in FIG. 4, the connection assembly 60 may include a V-seal 76 of the type described above, or other like mechanism, to assist in forming this substantially air-tight seal. In an exemplary embodiment, a portion of the outer groove 72 may be defined by both the grommet housing 64 and the grommet retainer 66, and at least a portion of the cold dome grommet 78 may be disposed within the outer groove 72. Thus, the cold dome 26 may be indirectly connected to the connection assembly 60 and the connection assembly 60 may indirectly connect the hot dome 56 to the cold dome 26.

The outer groove 72 may be sized, shaped, and/or otherwise configured to substantially restrict and/or prohibit movement of the hot dome 56 in the normal radial direction 36 caused by, for example, vibration, thermal expansion, and/or thermal contraction. Groove 72 may be substantially oblong to facilitate movement in the aligned radial direction 32 and substantially restrict movement in the normal radial direction 36. Such a groove may result in a non-uniform gap between, for example, the cold wall 26 and/or the cold wall grommet 78 and the grommet housing 64. It is understood that in another exemplary embodiment, the groove 72 may be substantially circular and the cold dome grommet 78 and/or the cold dome 26 may be, for example, non-circular, elliptical, and/or oblong. Such a configuration may substantially restrict movement in the normal radial direction 36.

Substantially restricting movement of the hot dome 56 in the normal radial direction 36 may be desirable in annular combustors 16 of the type described herein. For example, such a configuration may allow for accurate, uniform, and consistent positioning of the internal components of the combustor during warm-up, steady-state operation, and cool down, and may, thus, maintain the efficiency of the combustion process during operation. Such a configuration may also assist in maintaining a desired spacing and/or alignment between, for example, the hot dome 56 and the cold dome 26, the outer cold liner 40 and the outer hot liner 42, and/or the inner cold liner 46 and the inner hot liner 48. In particular, restricting movement in the normal radial direction 36 may assist in maintaining a constant gap width between, for example, the domes 26, 56 regardless of dome temperature. The gap width may correspond to the dimensions of channel 50. It is understood that a desired gap width may be chosen to maximize cooling effectiveness based on, for example, the number, diameter, and/or location of impingement holes 44 used. Thus, holding the desired gap width constant during operation may maximize impingement cooling effectiveness throughout warm-up, steady-state operation, and cool down of the combustor 16. It is understood that the combustor 16 may be configured such that the desired gap width between, for example, the cold dome 26 and the hot dome 56 may be achieved at steady-state temperatures and pressures. Thus, maximum impingement cooling effectiveness may be achieved at steady-state due to the expansion of the hot dome 56 relative to the cold dome 26 in the aligned radial direction 32.

Figure 5:
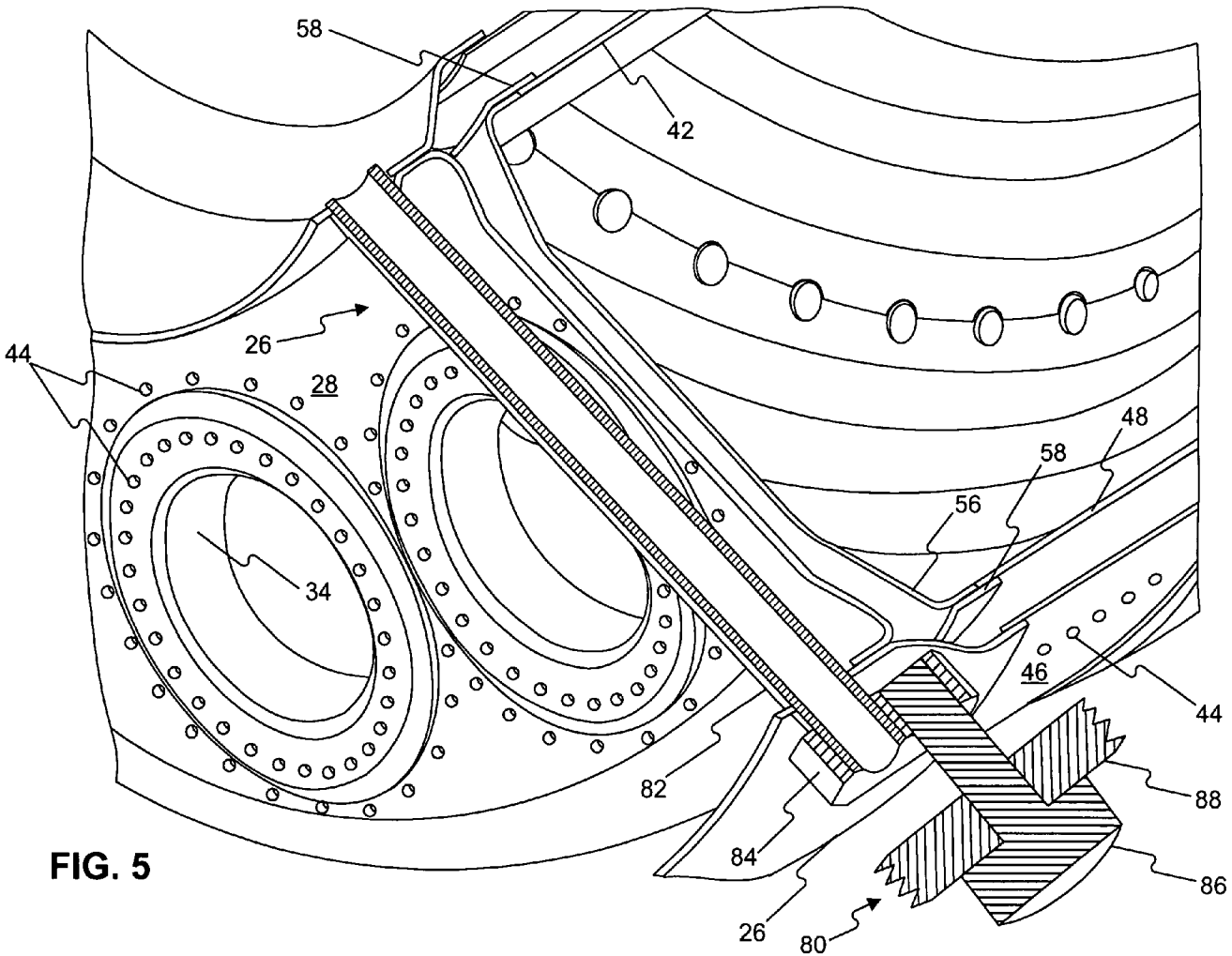
FIG. 5 is yet another partial cross-sectional view of the combustor of FIG. 2.

As shown in FIG. 5, the combustor 16 may further include a pin assembly 80. As will be described in greater detail below, the pin assembly 80 may be configured to indirectly support components of the combustor 16. Such components may include, for example, the hot dome 56. The combustor 16 may include an appropriate number of pin assemblies 80, appropriately positioned circumferentially about the combustor 16, so as to provide the required support to combustor components. Each pin assembly 80 may include a pin sleeve 82 directly connected to the inner ring 31 of the cold dome 26. In an exemplary embodiment, the pin sleeve 82 may be hollow and substantially cylindrical. The pin sleeve 82 may be formed from the same or similar materials as those described above with respect to the outer liners 40, 42, and may extend radially along a width of the combustor as shown in FIG. 5.

The pin sleeve 82 may be directly connected to a pin block 84. The pin block 84 may facilitate an indirect connection between the pin sleeve 82 and a housing pin 86 wherein the housing pin 86 is freely moveable within the pin block 84. The housing pin 86 may also be directly connected to the housing 88 of the engine 10 and may be supported thereby. In addition to supporting individual components of the combustor 16, the pin assembly 80 may be configured, generally, to assist in supporting the combustor 16 within the housing 88 of the engine 10.

INDUSTRIAL APPLICABILITY

The disclosed annular combustor 16 may be used with any machine and/or in any other environment known in the art in which turbine engines are used as a power source. Such machines and/or environments may include, for example, jet aircraft, helicopters, and power plants.

During operation, combustor components may experience a significant increase in temperature as a result of the combustion process. Each of these components may be formed from different materials and may have different dimensions, thicknesses, and/or other configurations. Each of these components may also be disposed in different locations relative to the fuel injector 20 (FIG. 1), the source of fuel for the combustion reaction, and may be exposed to different temperatures during the combustion reaction. For example, referring to FIG. 3, the cold dome 26 and cold liners 40, 46 may be relatively shielded from the intense temperatures of the combustion reaction by the hot dome 56 and hot liners 42, 48, respectively. In addition, the effectiveness of impingement cooling on the domes 26, 56 and the liners 40, 42, 46, 48 may vary based on the different dimensions, thicknesses, and/or other configurations of these components. Thus, the temperature and amount of thermal expansion experienced by, for example, the hot dome 56 may be different than the temperature and thermal expansion experienced by the cold dome 26 during operation of the annular combustor 16. More particularly, the temperature and thermal expansion of the hot dome 56 may be greater than that of the cold dome 26 during operation.

Directly connecting the cold dome 26 and the hot dome 56 may cause serious damage to the domes 26, 56 due to the stresses applied during operation and may result in structural failure. Thus, an indirect connection means may be used to connect such components while providing for the differences in thermal growth.

On the other hand, indirectly connecting the domes 26, 56 so as to permit unrestrained relative movement therebetween in, for example, the normal radial direction, may result in variations in the accuracy, uniformity, and consistency with which the domes 26, 56 may be positioned within the combustor 16 during warm-up, steady-state operation, and cool down. Such movement and/or expansion may also result in inconsistent spacing and/or alignment between the domes 26, 56, between the outer cold liner 40 and the outer hot liner 42, and between the inner cold liner 46 and the inner hot liner 48. Such inconsistencies may reduce the effectiveness of the impingement cooling process and may hinder the combustion process.

Accordingly, the connection assembly 60 of the present disclosure indirectly connects the hot dome 56 and the cold dome 26. The connection assembly 60 also substantially restricts movement of the hot dome 56 in the normal radial direction 36 at the forward end 54 of the combustor 16. This restriction may assist in maintaining a desired gap width between the domes 56, 26. It is understood that the connection assembly 60 also substantially restricts movement of the hot dome 56 in the direction of the longitudinal injector grommet axis 35 at the forward end 54. The connection assembly 60 is configured to maintain a constant alignment between the domes 26, 56 in the aligned radial direction 32, and to permit different amounts of radial thermal expansion therebetween. It is understood that the restricted movement in the normal radial direction 36 and the permitted movement in the aligned radial direction 32 are both with respect to the longitudinal grommet axis 35 (FIG. 2).

For example, as the hot dome 56 expands during operation, the hot dome 56, connector 62, grommet housing 64, and grommet retainer 66 move together, as a single directly connected unit. As the cold dome 26 expands during operation, the cold dome 26 and the cold dome grommet 78 will also move as a directly connected unit. Because hot dome 56 experiences a greater thermal expansion than cold dome 26, however, the connection assembly 60 will move, relative to the cold dome 26, in the direction of arrow 90 (FIG. 4), and will accept the cold dome grommet 78 into the outer groove 72 to permit relative movement in the aligned radial direction 32. It is understood that each of the combustor components exposed to an increase in temperature may expand in all directions due to thermal expansion. Thus, although both domes 26, 56 may expand in every direction during operation, greater thermal expansion of the hot dome 56 relative to the cold dome 26 causes the relative movement of the hot dome 56 depicted by arrow 90.

Figure 6:
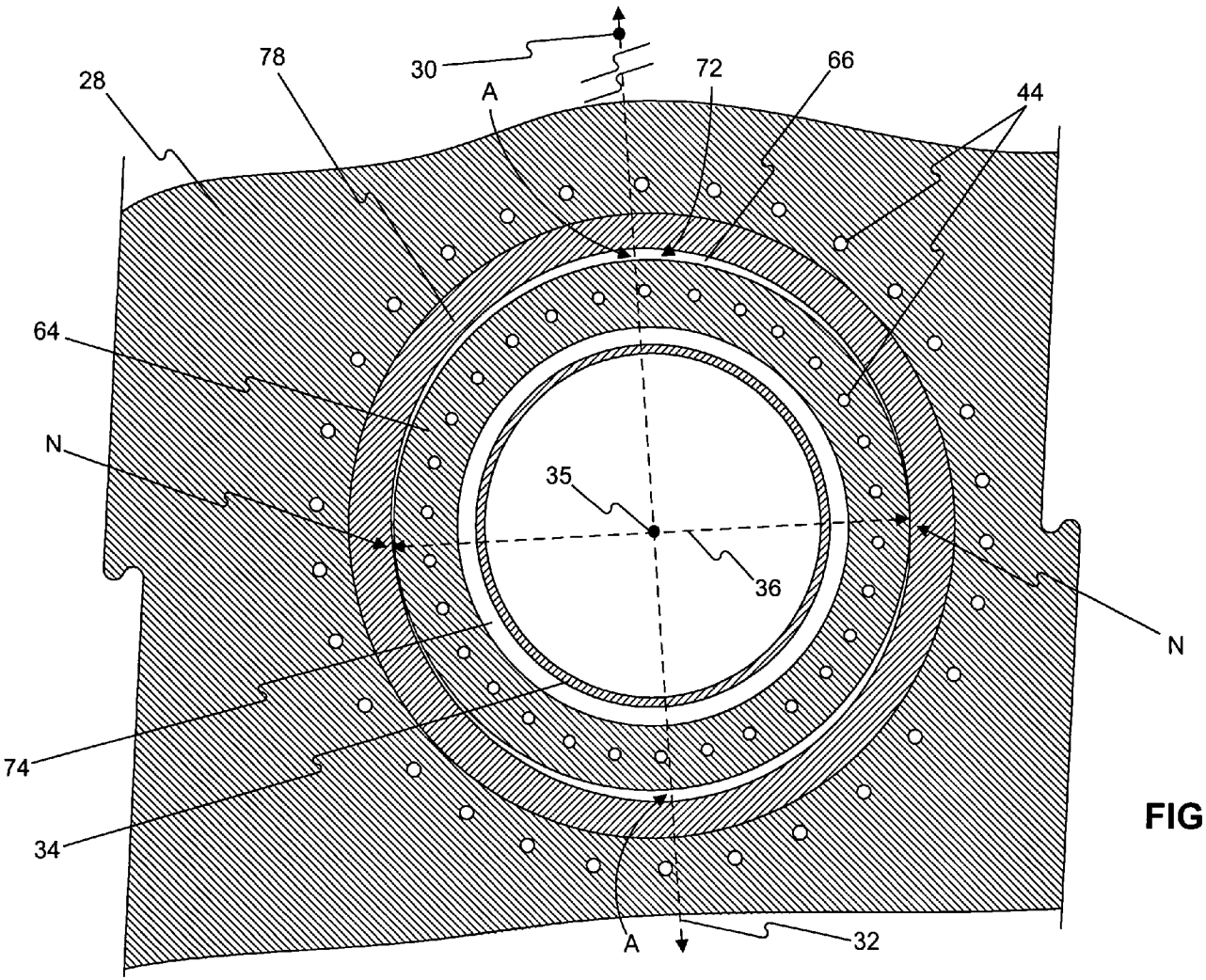
FIG. 6 is a further partial cross-sectional view of the combustor of FIG. 2 taken at section 6-6 of FIG. 4.

As shown in FIG. 6, the outer groove 72 of the connection assembly 60 is substantially elliptical or oblong in the aligned radial direction 32. The outer groove 72 is sized, shaped, and otherwise configured to substantially restrict movement of the hot dome 56 in the normal radial direction 36 during operation. For example, the grommet housing 64 may abut the cold dome grommet 78 at positions N to restrict normal radial movement of the hot dome 56 relative to the cold dome 26. Restricting movement of the hot dome 56 in the normal radial direction 36 also assists in maintaining a desired gap width along the circumference of the combustor 16 by maintaining the concentricity of the domes 26, 56. As explained above, thermal expansion differences between the cold dome 26 and the hot dome 56 in the aligned radial direction 32 may not adversely affect impingement cooling effectiveness.

Outer groove 72 may also be sized, shaped, and otherwise configured to allow relative movement between the domes 26, 56. The outer groove 72 maintains constant alignment between the hot dome 56 and the cold dome 26 in the aligned radial direction 32. As illustrated in FIG. 6, outer groove 72 may allow for the maximum relative movement in the aligned radial direction 32 at locations A, 90° away from locations N in the aligned radial direction 32. Thus, the outer groove 72 may be configured to permit an increasing amount of radial movement from locations N, where movement is substantially restricted, to locations A.

Figure 7:
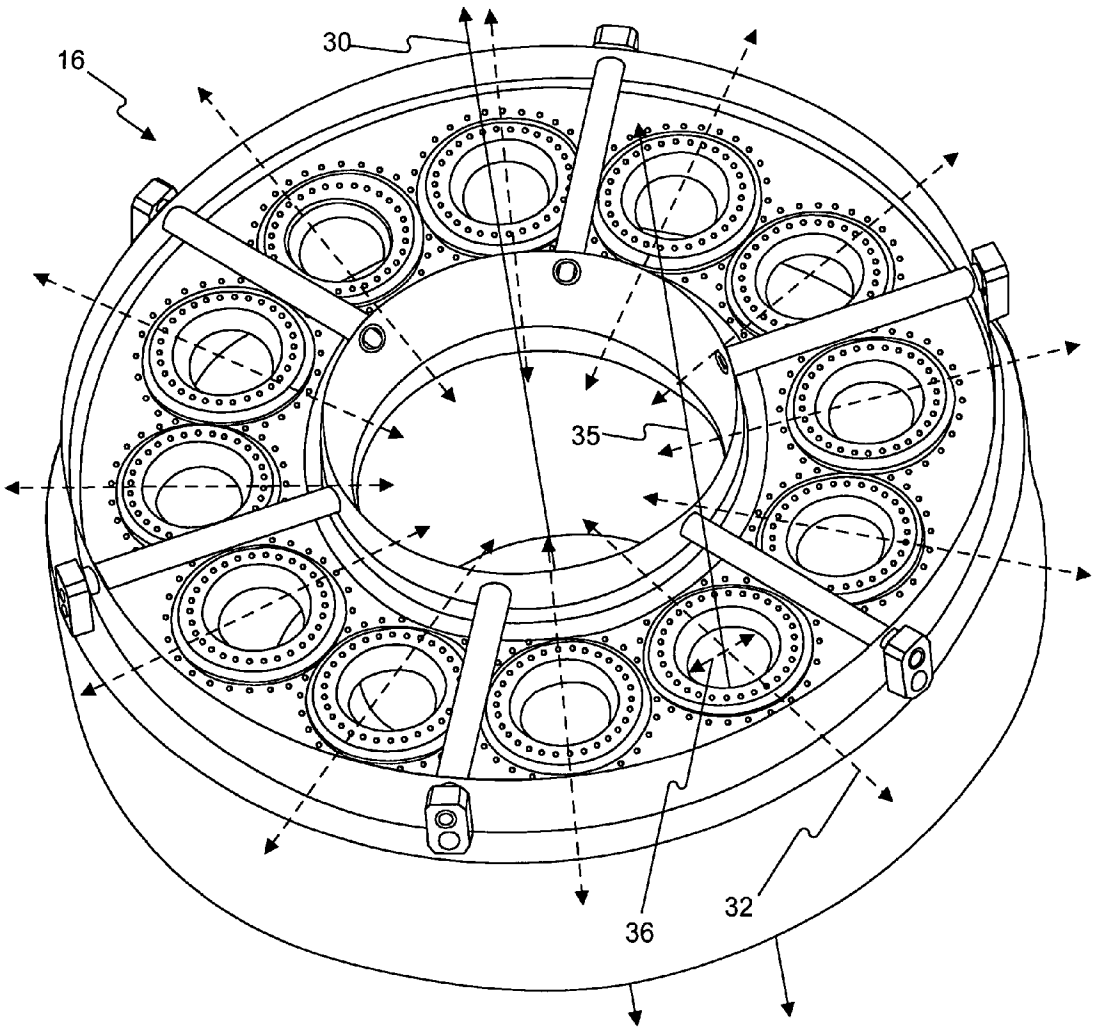
FIG. 7 is another isometric view of the combustor of FIG. 2.

FIG. 7 further illustrates the direction of hot dome expansion relative to the cold dome 26. As shown by aligned radial direction arrows 32, the hot dome (not shown) expands in the aligned radial direction relative to the cold dome 26 both toward and away from the combustor longitudinal axis 30. Such expansion occurs at all points along the hot dome 56, and the outer groove 72 (FIG. 6) may permit directed radial movement in the aligned radial direction 32. Each aligned radial direction arrow 32 may correspond to a direction passing through a longitudinal injector grommet axis 35 and the longitudinal combustor axis 30. Normal radial direction arrow 36 of FIG. 7 further illustrates the direction of substantially restricted movement.

During operation of the combustor 16, the connection assembly 60 of the present disclosure may also assist in reducing the thermal stresses applied to combustor components directly and/or indirectly connected thereto. For example, it is understood that exposing combustor components to elevated temperatures may cause expansion. The change in radius of a given combustor component may be expressed by the following equation:

$$\Delta R = R\alpha\Delta t,$$

where $\Delta R$ represents the change in radius (R), $\alpha$ represents the coefficient of expansion, and $\Delta t$ represents the change in temperature. It is understood that thermal stress may be proportional to the change in radius and that, at elevated temperatures, a combustor component having a relatively large radius may experience greater thermal stress than a component having a relatively small radius. For example, as shown in FIG. 5, the radius of, for example, the injector grommet 34 is smaller than, the radius of, for example, a housing 88 of the engine 10. Thus, at a given temperature, the injector grommet 34 may experience a smaller change in radius than the housing 88. Accordingly, supporting combustor components with a connection assembly 60 having an indirect connection with the injector grommet 34 may impart less thermal stress to the supported components at elevated temperatures than supporting the components with a connection assembly 60 connected to a structure having larger radius.

Furthermore, during the combustion process, different components of the combustor 16 will experience different pressure forces based on their location within the combustor 16. For example, the pressure at positions P' (FIG. 3) between the cold liners 40, 46 and the hot liners 42, 48 is higher than the pressure at position P within the combustor 16. It is understood that the pressure within the combustor, such as, for example, at position P, will always be the lowest pressure in the system. This difference in pressure between positions P' and P results in a force being exerted on substantially the entire surface of the hot dome 56. This pressure force acts perpendicular to the hot dome 56 at all points along substantially the entire surface and may have a magnitude of roughly 2% of the pressure within the combustor. An exemplary illustration of such a force is illustrated by arrows 92 in FIG. 3. It is understood that this pressure force may also act on all surfaces of the inner portion of the combustor 16.

For example, in an exemplary embodiment of the present disclosure, the pressure within the combustor 16 at position P may be approximately 250 psi. Such an internal pressure may correspond to a pressure force of approximately 5 psi (a pressure differential of approximately 2%) acting on the hot dome 56 in the direction of arrows 92.

The pressure forces acting on the hot dome 56 must be counterbalanced in order to maintain consistent positioning of the hot dome 56 during operation for the reasons discussed above. The force needed to counterbalance these pressure forces is provided by the housing 88 of the engine 10 through the pin assembly 80 directly connected to the cold dome 26 (FIG. 5). For example, as explained above, the hot dome 56 may experience a pressure force of 5 psi during operation. The hot dome 56 may transmit a fraction of this pressure force to each of the combustor connection assemblies 60 through the direct connection between each connection assembly 60 and the hot dome 56. Each connection assembly 60 transmits this pressure force to the cold dome 26 through the indirect connection between the cold dome grommet 78, and the grommet retainer 66 and grommet housing 64 of the connection assembly 60. The cold dome 26 is secured in place by the pin assembly 80 directly connected thereto. More particularly, a number of pin sleeves 82 may be directly connected to the cold dome 26, as shown in FIG. 2. As FIG. 5 illustrates, each pin sleeve 82 may be directly connected to a housing pin 86 through a pin block 84, and the housing pin 86 may be directly connected to the housing 88. Accordingly, the pressure force seen by the hot dome 56 is at least partially carried by the pin assembly 80, and the pin assembly 80 is configured to indirectly support the hot dome 56. Such indirect support may result from a combination of direct and indirect connections therebetween and may assist in securing the hot dome 56 within the housing 88 of the engine 10.

Other embodiments of the disclosure will be apparent to those skilled in the art from consideration of the specification. For example, the combustor 16 may further include a number of heat dissipation devices, such as, for example, heat fins or other similar structures configured to reduce the temperature along areas of the combustor. In addition, in an exemplary embodiment, the housing pin 86 may be indirectly connected to the pin sleeve 82. In such embodiments, the pin block 84 may be omitted.

It is intended that the specification and examples be considered as exemplary only, with the true scope of the invention being indicated by the following claims.

What is claimed is:

1. A combustor comprising:

a forward end including a hot dome, a cold dome, and a channel defined between the hot dome and the cold dome, impingement holes formed in the cold dome and communicating with the channel to bring cooling air into the channel which impinges onto the hot dome;

a combustion zone where combustion of a fuel-air mixture occurs, the combustion zone being at least partially enclosed by the hot dome;

a connection assembly defining an injector opening through the hot dome and the cold dome and into the combustion zone, an fuel injector being positionable in the injector opening to bring fuel into the combustion zone, the connection assembly including an annular inner groove opening into the injector opening, and an annular outer groove with a diameter greater than the inner groove;

at least one of the hot dome and the cold dome is indirectly connected to the connection assembly by a portion of the one of the hot dome and the cold dome being positioned in the outer groove with a sliding fit, and the other of the hot dome and the cold dome is directly connected to the connection assembly; and an injector grommet is indirectly connected to the connection assembly by a portion of the grommet being positioned in the inner groove with a sliding fit.

2. A combustor according to claim 1 wherein the connection assembly further comprises a grommet retainer and a grommet housing, the grommet retainer and the grommet housing being formed as separate components and then directly connected together upon assembly of the combustor, the inner annular groove and the outer annular groove being formed between the grommet retainer and the grommet housing.

3. A combustor according to claim 2 wherein the grommet retainer and the grommet housing have mutual threads engaged with one another to attach the grommet retainer to the grommet housing.

4. A combustor according to claim 1 further comprising:

a hot liner directly connected to the hot dome;

a cold liner directly connected to the cold dome; and the combustion zone is at least partially enclosed by the hot liner and the hot dome.

5. A combustor according to claim 1 wherein a plurality of the impingement holes are formed through the connection assembly to permit cooling air to pass through the connection assembly and impinge upon the hot dome.

6. A combustor according to claim 1 wherein at least one of the outer groove and the portion of the at least one of the hot dome and the cold dome positioned in the outer groove is oblong, such that a non-uniform gap is formed therebetween.

7. A combustor comprising:

an annular combustion chamber annularly positioned around a longitudinal combustor axis, where a fuel-air mixture is combusted in the combustion chamber;

a forward end including an annular hot dome, an annular cold dome spaced from and not directly connected to the hot dome, and impingement holes formed through the cold dome to direct cooling air to impinge upon and cool the hot dome, the cold dome including a cold dome face which faces away from the hot dome and which is generally normal to the longitudinal axis, the cold dome and the hot dome being annularly positioned about the longitudinal axis;

an annular inner hot liner and an annular inner cold liner spaced from the inner hot liner; impingement holes formed through inner cold liner to direct cooling air to impinge upon and cool the inner hot liner, the inner hot liner and the inner cold liner annularly positioned about the longitudinal axis, the inner hot liner and the inner cold liner being directed connected to one another at the aft end of the combustor;

an annular outer hot liner and an annular outer cold liner spaced from the outer hot liner; impingement holes formed through outer cold liner to direct cooling air to impinge upon and cool the outer hot liner, the outer hot liner and the outer cold liner annularly positioned about the longitudinal axis, the outer hot liner and the outer cold liner being directed connected to one another at the aft end of the combustor;

the annular combustion chamber being partially enclosed by the hot dome, the inner hot liner, and the outer hot liner, and the annular combustion chamber being open at the aft end of the combustor;

a connection assembly forming an injector opening through the hot dome and the cold dome, the injector opening communicating between the cold dome face and the combustion chamber; the cold dome being indirectly connected to the connection assembly, and the hot dome being directly connected to the connection assembly; and a grommet positioned in the injector opening and being indirectly connected to the connection assembly.

8. A combustor according to claim 7 wherein the connection assembly further comprises:

an annular inner groove, and the grommet is indirectly connected to the connection assembly via a portion of the grommet which is positioned in the inner groove in a sliding fit; and an annular outer groove with a diameter greater than the inner groove, and the cold dome is indirectly connected to the connection assembly via a portion of the cold dome which is positioned in the outer groove in a sliding fit.

9. A combustor according to claim 8 wherein the connection assembly further comprises:

a grommet retainer and a grommet housing, the grommet retainer and the grommet housing being formed as separate components and then directly connected together upon assembly of the combustor, the inner groove and the outer groove being formed between the grommet retainer and the grommet housing.

10. A combustor according to claim 9 wherein the grommet retainer and the grommet housing have mutual threads engaged with one another to attach the grommet retainer to the grommet housing.

11. A combustor according to claim 8 wherein at least one of the outer groove and the portion of the cold dome which is positioned in the outer groove is oblong so that a non-uniform gap is formed between the outer groove and the portion of the cold dome which is positioned in the outer groove.

12. A combustor according to claim 11 wherein the non-uniform gap permits radial movement of the cold dome relative to the connection assembly in substantially only a single direction.

13. A combustor comprising:

an annular combustion chamber annularly positioned around a longitudinal combustor axis, where a fuel-air mixture is combusted in the combustion chamber;

a forward end including an annular hot dome, an annular cold dome spaced from and not directly connected to the hot dome, and impingement holes formed through the cold dome to direct cooling air to impinge upon and cool the hot dome, the cold dome including a cold dome face which faces away from the hot dome and which is generally normal to the longitudinal axis, the cold dome and the hot dome being annularly positioned about the longitudinal axis;

an annular inner hot liner and an annular inner cold liner spaced from the inner hot liner; impingement holes formed through inner cold liner to direct cooling air to impinge upon and cool the inner hot liner, the inner hot liner and the inner cold liner annularly positioned about the longitudinal axis, the inner hot liner and the inner cold liner being directed connected to one another at the aft end of the combustor;

an annular outer hot liner and an annular outer cold liner spaced from the outer hot liner; impingement holes formed through outer cold liner to direct cooling air to impinge upon and cool the outer hot liner, the outer hot liner and the outer cold liner annularly positioned about the longitudinal axis, the outer hot liner and the outer cold liner being directed connected to one another at the aft end of the combustor;

the annular combustion chamber being partially enclosed by the hot dome, the inner hot liner, and the outer hot liner, and the annular combustion chamber being open at the aft end of the combustor;

an annular connection assembly, the cold dome being connected to the connection assembly so that the cold dome can move relative to the connection assembly in a radial direction away from the longitudinal axis but cannot move relative to the connection assembly in an axial direction parallel to the longitudinal axis, and the hot dome being connected to the connection assembly so that it cannot move relative thereto; and a grommet positioned in the injector opening and being connected to the connection assembly so that the grommet can move relative to the connection assembly in a radial direction away from the longitudinal axis but cannot move relative to the connection assembly in an axial direction parallel to the longitudinal axis.

14. A combustor according to claim 13 wherein the connection assembly further comprises:

an annular inner groove, and the grommet is connected to the connection assembly via a portion of the grommet which is positioned in the inner groove in a sliding fit; and an annular outer groove with a diameter greater than the inner groove, and the cold dome is connected to the connection assembly via a portion of the cold dome which is positioned in the outer groove in a sliding fit.

15. A combustor according to claim 14 wherein the connection assembly further comprises:

a grommet retainer and a grommet housing, the grommet retainer and the grommet housing being formed as separate components and then directly connected together upon assembly of the combustor, the inner groove and the outer groove being formed between the grommet retainer and the grommet housing.

16. A combustor according to claim 15 wherein the grommet retainer and the grommet housing have mutual threads engaged with one another to attach the grommet retainer to the grommet housing.

17. A combustor according to claim 14 wherein the connection assembly further comprises:

a first seal positioned in the inner groove between the portion of the grommet and the connection assembly; and a second seal positioned in the outer groove between the portion of the cold dome and the connection assembly.

* * * * *